United States Patent [19]

Osczevski et al.

[11] Patent Number: 5,027,458

[45] Date of Patent: Jul. 2, 1991

[54] COLLAPSIBLE HEAT INSULATING MATTRESS HAVING FOAM LATTICE CELLS AND A SLIT FOIL SHEET COVERING

[75] Inventors: Randall J. Osczevski, Nepean; Brian Farnworth, Delta, both of Canada

[73] Assignee: Her Majesty the Queen in right of Canada, as represented by the Minister of National Defence, Canada

[21] Appl. No.: 473,450

[22] Filed: Feb. 1, 1990

[51] Int. Cl.[5] ..... A47C 27/00

[52] U.S. Cl. ..... 5/448; 5/481

[58] Field of Search ..... 5/448, 481, 478, 479, 5/465, 181, 185

[56] References Cited

U.S. PATENT DOCUMENTS

| | | | |
|---|---|---|---|
| 1,211,548 | 1/1917 | Courts | 5/465 |
| 2,588,823 | 3/1952 | Glassman | 5/481 |
| 2,768,924 | 10/1956 | Wright | 5/448 |
| 3,707,009 | 12/1972 | Wagner | 5/448 |
| 4,713,854 | 12/1987 | Graebe | 5/448 |

FOREIGN PATENT DOCUMENTS

| | | | |
|---|---|---|---|
| 1188828 | 6/1985 | Canada . | |
| 2916110 | 10/1980 | Fed. Rep. of Germany | 5/448 |
| 1125394 | 5/1955 | France | 5/481 |

*Primary Examiner*—Gary L. Smith
*Assistant Examiner*—F. Saether
*Attorney, Agent, or Firm*—Stevens, Davis, Miller & Mosher

[57] ABSTRACT

A collapsible, heat insulating mattress is provided comprising at least one lattice structure of a foamed plastics material which has an open lattice structure in the relaxed condition, and metal coated foil coverings on each side of the lattice structure with slits extending across the lattice openings. When the mattress is to be stowed it is squeezed to close the lattic openings and occupy less space. The slits allow the coverings to crumple and remain undamaged when the mattress is squeezed for stowing. The coverings may be sheets with the slits cut in them, strips laid side-by-side, either abutting or overlapping, and adhesively secured only at the lattice junctions to the lattice structure.

10 Claims, 1 Drawing Sheet

Figure 1:
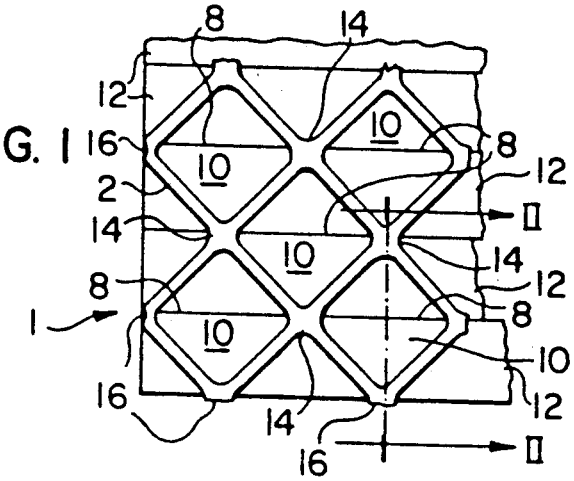

COLLAPSIBLE HEAT INSULATING MATTRESS HAVING FOAM LATTICE CELLS AND A SLIT FOIL SHEET COVERING

This invention relates to a collapsible, heat insulating mattress.

It has already been proposed in Canadian Patent No. 1,188,828, dated June 11, 1985, B. Farnworth and R.J. Osczevski, to provide a heat insulating mattress which is collapsible in a horizontal direction. In one embodiment the mattress comprises a flexible lattice network of foamed strips arranged across the width of the mattress. The interstices of the lattice network have a filling of an open-cell foam, polyester fibre-fill, down or feathers, and have a textile fabric envelope covering to hold the filling in place.

While the mattress of Farnworth and Osczevski has proved to be useful, when the mattress is compressed to be collapsed for stowage, each interstice in the lattice becomes wider in the direction perpendicular to the compressing force and narrower in the direction in which that force is applied. The fabric covering must stretch in one direction to accommodate this change in shape of the interstices and this increases the resistance of the mattress to being compressed to the collapsed condition. This resistance of the mattress to compression, in combination with the force required to compress the batting and to bend the lattice has been found to make it difficult to compress such a mattress with high thermal insulation to a desirably small bulk for stowage.

There is a need for a collapsible, heat insulating mattress which has high thermal insulation and which can be compressed to a desirably small bulk for stowage.

According to the present invention there is provided a collapsible, heat insulating mattress, comprising (a) a pliable, open lattice structure of heat insulating material and capable of pliantly resisting compression by the weight of a person reclining on one side face so that the lattice structure remains substantially open, the lattice structure being collapsible laterally for stowing from a relaxed, deployed orientation, with the lattice structure open, by at least partially compressing the lattice structure in a lateral direction from essentially open, lazy-tong shaped, deployed configurations to a structure resembling at least essentially partially closed lazy-tong shaped, stowing configurations, and (b) two coverings of a pliable, heat reflecting material with each one covering a side face of the lattice structure so that the lattice structure is sandwiched between the coverings, the coverings each having a plurality of spaced, elongated slits with each lattice opening having at least one slit extending across it and substantially closing that opening in the essentially open lazy-tong shaped deployed configuration but which will open and allow that covering to become crumpled in an undamaged condition when the lattice structure is in the said at least essentially partially closed, lazy-tong shaped, stowing configurations.

The lattice interstices may be essentially free of any mattress filling, e.g. fibrous insulating filling.

The lattice structure may be one of a stack of similar lattice structures, and the coverings may be two of a plurality of coverings, with coverings being interspersed between and covering adjacent side faces of two lattice structures.

The lattice structure may be of a foamed material.

The lattice structure may be of a sheet material with the lattice openings having been cut therein.

The coverings may be of a metal coated sheet of a plastics material, preferably an aluminum coated plastics material.

Each of the coverings may be a sheet with the spaced, elongated slits as cuts therein.

Each of the coverings may comprise a plurality of strips extending longitudinally side-by-side in abutting relationship, and each strip may be secured to the lattice structure.

Each of the coverings may comprise a plurality of strips extending longitudinally side-by-side with marginal lengthwise extending edge portions of the strips overlapping one another, and each strip may be secured to the lattice structure.

Figure 2:
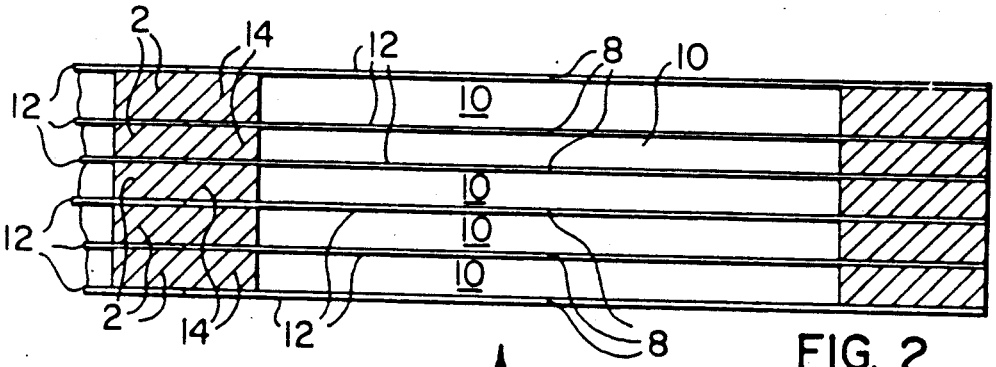
Figure 3:
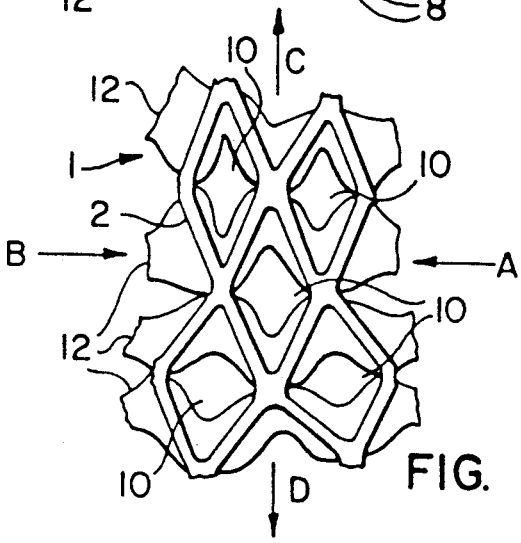
Figure 4:
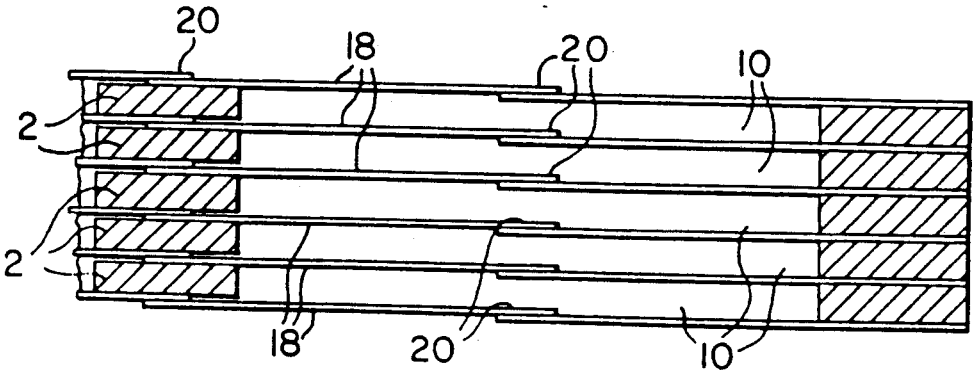

In the accompanying drawings which illustrate, by way of example, embodiments of the present invention, FIG. 1 is a plan view of a typical portion of a collapsible heat insulating mattress in a relaxed, deployed orientation with the top covering removed, FIG. 2 is a sectional end view along II—II, FIG. 1 with appropriate portion of the top covering in place, FIG. 3 is a similar view to FIG. 1 with the portion of the mattress partially compressed towards orientation for stowing, and FIG. 4 is a similar view to FIG. 2 but of a different collapsible, heat insulating mattress.

Referring now to FIGS. 1 to 3, there is shown a portion, generally designated 1, of a collapsible, heat insulating mattress, comprising:

(a) a plurality of pliable, open lattice structure 2 of heat insulating material and capable of pliantly resisting compression by the weight of a person reclining on one side face so that the lattice structure 2 remains substantially open (FIG. 1), the lattice structure 2 being collapsible laterally for stowing from a relaxed, deployed orientation (FIG. 1), with the lattice structure 2 open, by at least partially compressing the lattice structure in a lateral direction from essentially open lazy-tong shaped, deployed configuration (FIG. 1) to at least essentially partially closed lazy-tong shaped, stowing configurations, and (b) for each lattice structure 2, two coverings designated 12 of a pliable, heat reflecting material with each one covering a side face of the lattice structure so that the lattice structure 2 is sandwiched between the coverings, the coverings each having a plurality of spaced, elongated slits 8 with each lattice opening, such as those designated 10, having at least one slit 8 extending across it and substantially closing that opening 10 in the essentially open lazy-tong shaped, deployed configuration but which will open and allow that covering to become crumpled in an undamaged condition when the lattice structure 2 is in the said at least essentially partially closed lazy-tong shaped, stowing configurations.

The lattice structures 2 each comprises a layer of foam material with the openings 10 cut in it so that the lattice structures 2 are open in the relaxed state. The coverings 4 may each comprise a sheet with the slits 8 cut in it, or a plurality of strips, such as those designated 12, extending side-by-side in abutting relationship along the lattice structure 2. The sheets or strips 12 are of an aluminized plastic film secured to the lattice structure.

As shown in FIG. 3, when the mattress 1 is compressed in the directions of arrows A and B for stowing for, for example, transportation, the openings 10 are elongated in the directions of arrows C and D. The compressing is continued until the openings 10 are more or less closed and then the mattress 1 is ready to be stowed.

When the mattress is being compressed, the slits 8 open as shown in FIG. 3 to allow the strips to crumple and accommodate the change in shape of the openings 10.

To support the weight of a man it has been found that openings 10 with a dimension across the diagonals of about 10 cm is optimum. A suitable width for the openings 10 between the strips 12 is about 2.5 cm. The requisite number of stacked lattice structures 2 will depend on the thermal insulation that is needed. If one lattice structure 2 can be made of sufficient thickness, will support the body weight and yet be collapsible for stowage, then one lattice structure 2 may suffice. To this end the junctions 14 may be weakened for collapsing for stowing by providing small grooves extending along the V's.

The mattress 1 may be encased in a textile fabric envelope (not shown).

In FIG. 4, similar parts to those shown in FIGS. 1 to 3 are designated by the same reference numerals and the previous description is relied upon to describe them.

In FIG. 4 strips 18 are provided which are similar to the strips 12 but which have marginal lengthwise extending edge portions 20 which overlap a strip 18 adjacent thereto. This overlap will ensure that the strips 18 will not have openings between them at the openings 10 if the mattress fails to open the lattice structure to the fullest extend or if the mattress is used on an uneven surface.

In other embodiments of the present invention the lattice structure 2 is fabricated from strips of the foam material which are slotted at the lattice junctions 14 to interlock.

Suitable materials for the lattice structure 2 are, for example, foamed or expanded, open or closed cell polyethylene or ethylene vinyl acetate.

We claim:

1. A collapsible, heat insulating mattress, comprising:

(a) a pliable, open lattice structure of heat insulating material capable of resisting compression by the weight of a person reclining on one side face thereof, the lattice structure being collapsible laterally for stowing by at least partially compressing the lattice structure in a lateral direction from essentially open, deployed configuration to an at least partially closed stowing configuration and (b) two coverings of a pliable, heat reflecting material, each one covering a side face of the lattice structure so that the lattice structure is sandwiched between the coverings, and a plurality of spaced, elongated slits in each of the coverings, each lattice opening having at least one slit extending across it, such that when said lattice structure is in the essentially open, deployed configuration and when the lattice structure is in the at least partially closed, stowing configuration the slits are open to allow the coverings to become crumpled in an undamaged condition.

2. A mattress according to claim 1, wherein the lattice openings are essentially free of any mattress filling.

3. A mattress according to claim 1, wherein the lattice structure is one of a stack of similar lattice structures, and the coverings are two of a plurality of coverings, with coverings being interspersed between and covering adjacent side faces of two lattice structures.

4. A mattress according to claim 1, wherein the lattice structure is of a foamed material.

5. A mattress according to claim 1, wherein the lattice structure is of a sheet material with the lattice openings having been cut therein.

6. A mattress according to claim 1, wherein the coverings are of a metal coated sheet of a plastics material.

7. A mattress according to claim 6, wherein the coverings are of an aluminum coated plastics material.

8. A mattress according to claim 1, wherein each of the coverings is a sheet with the spaced, elongated slits as cuts therein.

9. A mattress according to claim 1, wherein each of the coverings comprises a plurality of strips extending longitudinally side-by-side in abutting relationship, and each strip is secured to the lattice structure.

10. A mattress according to claim 1, wherein each of the coverings comprises a plurality of strips extending longitudinally side-by-side with marginal lengthwise extending edge portions of the strips overlapping one another, and each strip is secured to the lattice structure.

* * * * *